United States Patent [19]

Ando et al.

[11] 4,299,610

[45] Nov. 10, 1981

[54] METHOD AND APPARATUS FOR MANUFACTURING CRYSTALLINE BLAST FURNACE SLAG

[75] Inventors: Ryo Ando; Shigeru Araki, both of Yokohama; Hideaki Hoshi, Tokyo; Kazuyoshi Sato, Kawasaki, all of Japan

[73] Assignee: Nippon Kokan Kabushiki Kaisha, Tokyo, Japan

[21] Appl. No.: 133,931

[22] Filed: Mar. 25, 1980

[30] Foreign Application Priority Data

Apr. 13, 1979 [JP] Japan ..... 54-44191
Jan. 22, 1980 [JP] Japan ..... 55-5965

[51] Int. Cl.[3] ..... C04B 5/00

[52] U.S. Cl. ..... 65/19; 65/32; 65/137; 65/157; 65/356; 425/261; 425/443; 425/815

[58] Field of Search ..... 65/19, 32, 122, 137, 65/157, 326, 356; 425/261, 443, 815

[56] References Cited

U.S. PATENT DOCUMENTS

| | | | |
|---|---|---|---|
| 140,927 | 7/1873 | Kloman | 65/19 |
| 810,864 | 1/1906 | Hoover et al. | 65/356 |
| 2,044,198 | 6/1936 | Bartholomew | 65/19 |
| 2,901,865 | 9/1959 | McCormick | 65/356 |
| 4,004,874 | 1/1977 | Foster | 425/443 X |

FOREIGN PATENT DOCUMENTS

| | | |
|---|---|---|
| 102292 | 9/1978 | Japan . |
| 153083 | 10/1920 | United Kingdom . |

*Primary Examiner*—Richard V. Fisher
*Attorney, Agent, or Firm*—Frishauf, Holtz, Goodman and Woodward

[57] ABSTRACT

A method and an apparatus for manufacturing a crystalline blast furnace slag, which comprises: endlessly connecting at prescribed intervals a plurality of rectangular metal cooling bodies each with a hollow for cooling water, to form a plurality of cooling grooves with a width at the top end thereof of from 40 to 80 mm corresponding to said prescribed intervals and a depth of from 100 to 300 mm and becoming narrower toward the depth thereof, each between two adjacent ones of said cooling bodies; continuously pouring a molten blast furnace slag sequentially into said plurality of cooling grooves in an atmosphere of an inert gas and/or a reducing gas, while moving said plurality of cooling bodies endlessly connected in circulation in the connecting direction thereof; and, circulating a cooling water through said hollows for cooling water of said plurality of cooling bodies during the pouring of said molten blast furnace slag into said plurality of cooling grooves, to cool said plurality of cooling bodies, thereby cooling and solidifying said molten blast furnace slag poured into said plurality of cooling grooves by the contact with mutually facing outer surfaces of two adjacent ones of said cooling bodies thus cooled, to manufacture a crystalline blast furnace slag.

5 Claims, 9 Drawing Figures

METHOD AND APPARATUS FOR MANUFACTURING CRYSTALLINE BLAST FURNACE SLAG

REFERENCE TO PATENTS, APPLICATIONS AND PUBLICATIONS PERTINENT TO THE INVENTION

As far as we know, a prior document pertinent to the present invention is Japanese Pat. Provisional Publication No. 102,292/78 dated Sept. 6, 1978.

The content of the prior art disclosed in the above-mentioned prior document will be discussed under the heading of the "BACKGROUND OF THE INVENTION" presented hereafter.

FIELD OF THE INVENTION

The present invention relates to a method and an apparatus for manufacturing a crystalline blast furnace slag having a low porosity, producing substantially no yellow leaching liquid, and particularly adapted to serve as a coarse aggregate for concrete or a road subbase course material, and which give a cooling rate suitable for substantially completely crystallizing a molten blast furnace slag.

BACKGROUND OF THE INVENTION

A slow-cooled blast furnace slag applicable as a coarse aggregate for concrete or a road subbase course material, i.e., a crystalline blast furnace slag, has conventionally been manufactured as follows:

(1) Pouring a molten blast furnace slag discharged from a blast furnace through a slag runner into a pit, and slowly cooling the molten blast furnace slag in the pit in contact with open air while applying an appropriate water sprinkling;

(2) Pouring a molten blast furnace slag discharged from a blast furnace through a slag runner into a molten slag ladle mounted on a carriage, transferring the carriage to a slag treating yard having a slope, pouring the molten blast furnace slag from the molten slag ladle onto the slope of the slag treating yard, and slowly cooling the molten blast furnace slag poured onto the slope in contact with open air while applying an appropriate water sprinkling.

However, a molten blast furnace slag contains sulfur, carbon, nitrogen and hydrogen which are gasified by oxidation. On the other hand, the molten blast furnace slag discharged from a blast furnace entraps air during pouring from a slag runner into a pit or onto a slope of the slag treating yard. In the course of solidification of the molten blast furnace slag, therefore, sulfur in the molten blast furnace slag is, for example, gasified into sulfur dioxide through oxidation, a part of which is released to open air, and carbon in the molten blast furnace slag is gasified into carbon monoxide or carbon dioxide, a part of which is released to open air. On the other hand, since the molten blast furnace slag is cooled at a low cooling rate through solidification thereof, numerous developed large bubbles of gases produced through oxidation such as sulfur dioxide gas, carbon monoxide gas and carbon dioxide gas as mentioned above are entangled in the solidified blast furnace slag during solidification thereof. Therefore, the conventional slow-cooled blast furnace slag, i.e., the conventional crystalline blast furnace slag, which has thus a high porosity, involves the following problems when used as a coarse aggregate for concrete or a road subbase course material:

(a) When employing the crystalline blast furnace slag as a course aggregate for concrete, the high porosity of the crystalline blast furnace slag leads to a lower workability, and cement paste which fills numerous pores of the slag results in larger water and cement consumptions.

(b) Sulfur as a simple substance ($S^0$) is produced in the molten blast furnace slag during solidification thereof. The molten blast furnace slag contains, on the other hand, divalent sulfur ($S^{2-}$). Therefore, when the crystalline blast furnace slag containing simple-substance sulfur and divalent sulfur is used as a road subbase course material, the high porosity of the crystalline blast furnace slag causes production of polysulfide ions through reaction of water with simple-substance sulfur and divalent sulfur, thus resulting in the production of yellow leaching liquid, which is not desirable in environmental control, from the crystalline blast furnace slag. Because the crystalline blast furnace slag producing yellow leaching liquid is not desirable as a road subbase course material, the crystalline blast furnace slag can be used as a road subbase course material only after the completion of the reaction of water with simple-substance sulfur and divalent sulfur through positive production of yellow leaching liquid effected by the contact with water for a period of from three to six months in an appropriate treating yard.

(c) Since the crystalline blast furnace slag is manufactured by treating a large quantity of a molten blast furnace slag at a time, uniform cooling conditions cannot be given to the molten blast furnace slag at all places in a pit or on a slope of the slag treating yard. The crystalline blast furnace slag manufactured as mentioned above involves consequently large variations in the quality.

Under such circumstances, a method and an apparatus for treating a molten slag has been proposed in Japanese Pat. Provisional Publication No. 102,292/78, dated Sept. 6, 1978, which comprises:

continuously supplying a molten slag from above a rotating rotary drum through a slag runner onto the outer surface of said rotary drum, and on the other hand, blowing a cooling medium onto the inner surface of said rotary drum to cool the barrel of said rotary drum; cooling and solidifying said molten slag through contact with the outer surface of said rotary drum thus cooled, and simultaneously, cooling and solidifying, as required, said molten slag supplied onto the outer surface of said rotary drum by air blown from an ejecting nozzle arranged near said rotary drum; and, scraping out said solidified slag from the outer surface of said rotary drum by a scraper (hereinafter referred to as the "prior art").

The prior art, which has an advantage of not requiring a large space as in the above-mentioned conventional method for manufacturing a crystalline blast furnace slag comprising slowly cooling a molten blast furnace slag through contact with open air in a pit or on a slope of the slag treating yard, involves the following problems:

(i) The molten slag is supplied onto the outer surface of the rotary drum in open air. It is therefore inevitable that air is entangled into the molten slag during supply of the molten slag onto the outer surface of the rotary drum. In addition, the molten slag supplied onto the outer surface of the rotary drum contacts with air over a large area. As a result, the molten slag supplied onto the outer surface of the rotary drum is oxidized by air, thus causing production therein of such gases as sulfur dioxide, carbon monoxide and carbon dioxide as mentioned above. Since there is no restricting force imposed on the produced gases, this results in a solidified slag with a high porosity. The solidified slag thus obtained contains therein simple-substance sulfur and divalent sulfur which produce yellow leaching liquid through reaction with water. When employing an ejecting nozzle, the molten slag supplied onto the outer surface of the rotary drum is subjected to oxidation by air accelerated by the impact of compressed air from the ejecting nozzle.

(ii) Since the molten slag supplied onto the outer surface of the rotary drum forms a layer having a certain thickness on the outer surface of the rotary drum, cooling is started mainly from the portion in contact with the outer surface of the rotary drum. Therefore, a high cooling rate cannot be obtained over the entire molten slag supplied onto the outer surface of the rotary drum, thus making it difficult to prevent gas bubbles from developing.

(iii) The molten slag is continuously supplied onto the outer surface of the rotary drum through the slag runner. It is therefore difficult to supply the molten slag into a uniform thickness on the outer surface of the rotary drum. As a result, a solidified slag in uniform cooling conditions cannot be obtained.

SUMMARY OF THE INVENTION

A principal object of the present invention is therefore to provide a method and an apparatus for manufacturing a crystalline blast furnace slag, which permits cooling and solidifying a molten blast furnace slag substantially without causing oxidation.

An object of the present invention is to provide a method and an apparatus for manufacturing a crystalline blast furnace slag having a very low porosity.

Another object of the present invention is to provide a method and an apparatus for manufacturing a crystalline blast furnace slag adapted to serve as a coarse aggregate for concrete or a road subbase course material.

In accordance with one of the features of the present invention, there is provided a method for manufacturing a crystalline blast furnace slag, characterized by comprising the steps of:

endlessly connecting at prescribed intervals a plurality of rectangular metal cooling bodies with sharp top edges, each having a hollow for cooling water, to form a plurality of cooling grooves with a width at the top end thereof of from 40 to 80 mm corresponding to said prescribed intervals and a depth of from 100 to 300 mm and becoming narrower toward the depth thereof, each between two adjacent ones of said cooling bodies;

continuously moving said plurality of cooling bodies endlessly connected in circulation in the connecting direction thereof;

continuously pouring a molten blast furnace slag sequentially into said plurality of cooling grooves extending transversely to the moving direction of said plurality of cooling bodies, in an atmosphere of at least one of an inert gas and a reducing gas, while continuing to move said plurality of cooling bodies; and, circulating a cooling water through said hollows for cooling water of said plurality of cooling bodies during pouring of said molten blast furnace slag into said plurality of cooling grooves, to cool said plurality of cooling bodies, thereby cooling and solidifying said molten blast furnace slag poured into said plurality of cooling grooves by the contact with mutually facing outer surfaces of two adjacent ones of said cooling bodies thus cooled, to manufacture a crystalline blast furnace slag.

DETAILED DESCRIPTION OF PREFERRED EMBODIMENTS

Figure 1:
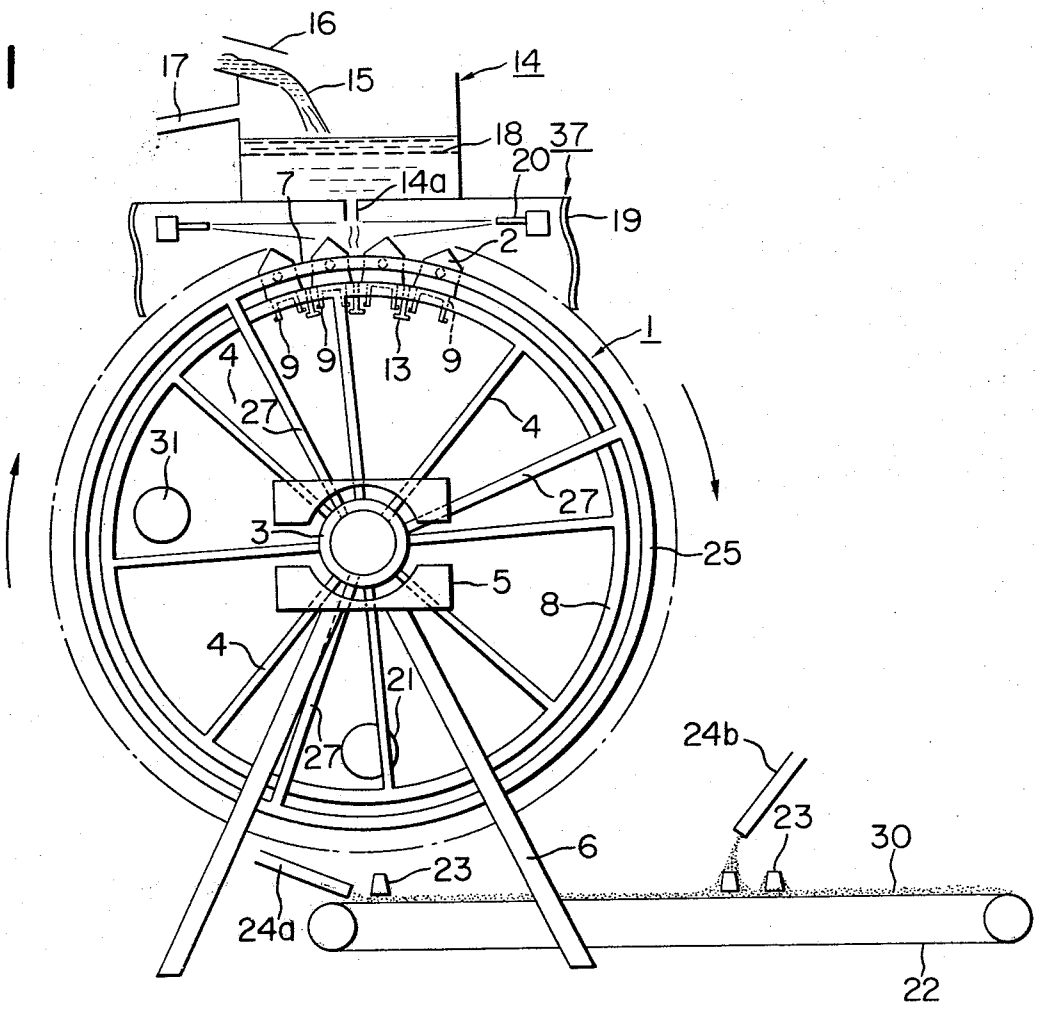
FIG. 1 is a schematic sectional view illustrating an embodiment of the apparatus for manufacturing a crystalline blast furnace slag of the present invention.

We carried out extensive studies with a view to solving the above-mentioned problems involved in the prior art. As a result, the following findings were obtained:

(1) By forming a plurality of narrow and deep cooling grooves of prescribed dimensions with a plurality of cooling bodies made of a metal having a high thermal conductivity such as copper, cooled in the interior, and by pouring a molten blast furnace slag into said cooling grooves, the following results can be obtained: (i) Because it is possible to limit the amount of molten blast furnace slag to be cooled per unit area of the above-mentioned cooling grooves always to under a certain amount, the molten blast furnace slag is always uniformly cooled, thus permitting manufacture of a crystalline blast furnace slag of a uniform quality; (ii) Because it is possible to limit the amount of molten blast furnace slag to be cooled always to under a certain amount, as described in (i) above, and in addition, because it is also possible to cool the molten blast furnace slag while restricting expansion thereof by the two mutually facing surfaces forming a cooling groove, it is possible to obtain a cooling rate and a restricting force sufficient to prevent production of bubbles in the molten blast furnace slag to be cooled and solidified; and, (iii) Since the molten blast furnace slag is poured into the cooling grooves, it is possible to reduce the area of the molten blast furnace slag in contact with air, thus minimizing the production of such gases as carbon monoxide, carbon dioxide and sulfur dioxide.

(2) By pouring the molten blast furnace slag in an atmosphere comprising at least one of an inert gas and a reducing gas into the cooling grooves described in (1) above, it is possible to prevent entanglement of air, i.e., oxygen gas, into the molten blast furnace slag poured into the cooling grooves.

(3) By forming the plurality of cooling grooves mentioned in (1) above through endless connection of the plurality of cooling bodies described in (1) above, arranging the plurality of cooling grooves thus formed to extend substantially transversely to the moving direction thereof, pouring the molten blast furnace slag into the moving cooling grooves in an atmosphere comprising at least one of an inert gas and a reducing gas as mentioned in (2) above, and taking out the cooled and solidified crystalline blast furnace slag from the cooling grooves, the following results can be obtained: (i) Since the molten blast furnace slag is poured into the cooling grooves, the amount of the molten blast furnace slag poured into the cooling grooves is always constant. On the other hand, since the cooling grooves extend substantially transversely to the moving direction thereof, it is possible to pour the molten blast furnace slag into the cooling grooves in a very short period of time; (ii) Because pouring of the molten blast furnace slag is effected in a very short period of time as mentioned in (i) above, the molten blast furnace slag remains in the high-temperature molten state for a very short period of time. In addition, pouring of the molten blast furnace slag into the cooling grooves is effected in an atmosphere comprising at least one of an inert gas and a reducing gas. It is therefore possible to prevent the production of such gases as carbon monoxide, carbon dioxide and sulfur dioxide and the development of bubbles in the molten blast furnace slag poured into the cooling grooves. Furthermore, because the molten blast furnace slag remains only for a very short period of time in the high-temperature molten state causing serious production of gases and development of bubbles, it is possible to substantially prevent the production of gases and the development of bubbles in the molten blast furnace slag poured into the cooling grooves even when at least one of an inert gas and a reducing gas is used only during pouring of the molten blast furnace slag into the cooling grooves, thus allowing manufacture of a crystalline blast furnace slag having a low porosity and producing substantially no yellow leaching liquid.

The present invention was made on the basis of the findings described in (1) to (3) above, and the method and the apparatus for manufacturing a crystalline blast furnace slag of the present invention is described below more in detail with reference to the drawings.

FIG. 1 is a schematic sectional view illustrating an embodiment of the apparatus for manufacturing a crystalline blast furnace slag of the present invention. In FIG. 1, 1 is a rotary drum; 2 is a plurality of hollow and rectangular cooling bodies with sharp top edges forming the barrel of the rotary drum 1; 3 is a hollow center axle of the rotary drm 1; 4 is a plurality of spokes connecting the barrel of the rotary drum 1 and the center axle 3; 5 is a pair of bearings supporting the both ends of the center axle 3; and, 6 is a pair of supporting legs which support the rotary drum 1.

As shown in FIG. 1, the plurality of cooling bodies 2 are mutually endlessly connected to form the substantially circular barrel of the rotary drum 1. By endlessly connecting at prescribed intervals the plurality of cooling bodies 2, a plurality of narrow and deep cooling grooves 7 extending substantially transversely to the rotating direction of the rotary drum 1 are formed on the outer surface thereof as described later. The pair of supporting legs 6 support on the ground the bearings 5 supporting the both ends of the center axle 3 so as to permit rotation of the rotary drum 1. The center axle 3 is driven by a driving mechanism (not shown), and thus, the rotary drum 1 rotates at a prescribed circumferential speed in the arrow direction in FIG. 1.

Figure 2:
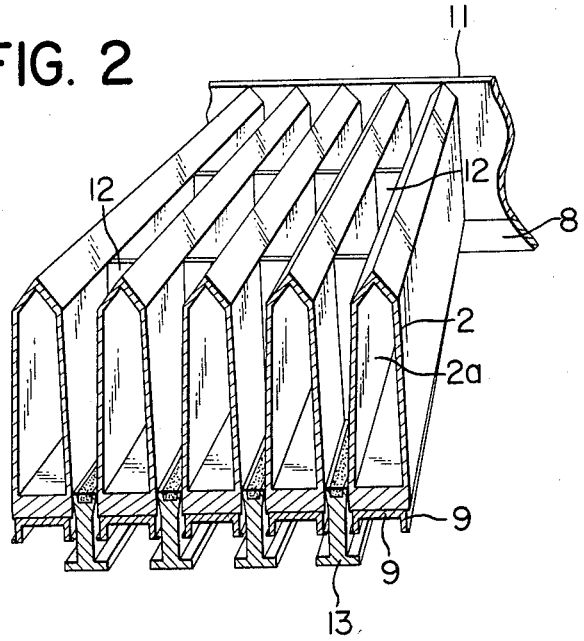
FIG. 2 is a partially cutaway perspective view illustrating an embodiment of a part of the barrel of the rotary drum which is one of the constituent components of the apparatus for manufacturing a crystalline blast furnace slag of the present invention.
Figure 3:
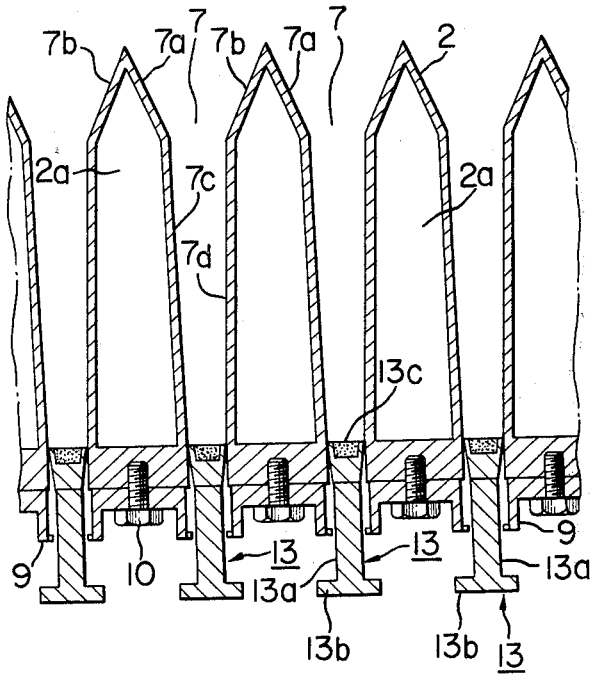
FIG. 3 is a schematic sectional view illustrating an embodiment of a part of the barrel of the rotary drum which is one of the constituent components of the apparatus for manufacturing a crystalline blast furnace slag of the present invention.

The most important features of the apparatus for manufacturing a crystalline blast furnace slag of the present invention lie in the plurality of cooling bodies 2 and the plurality of cooling grooves 7 formed on the outer surface of the barrel of the rotary drum 1, shown in FIGS. 2 and 3. FIG. 2 is a partially cutaway perspective view illustratng an embodiment of a part of the barrel of the rotary drum 1 which is one of the constituent components of the apparatus for manufacturing a crystalline blast furnace slag of the present invention, and, FIG. 3 is a schematic sectional view also illustrating an embodiment of a part of the barrel of the rotary drum 1. As shown in FIG. 2, the cooling body 2 has therein a hollow for cooling water 2*a*, and has a rectangular shape with a sharp top edge. The cooling body 2 should preferably be made of a metal having a high thermal conductivity such as copper, but may also be made of iron or steel. The barrel of the rotary drum 1 is formed as follows. As shown in FIGS. 1 and 2, each of a pair of mutually opposite annular frames 8 are fixed to ends of a plurality of spokes 4 which are fixed at the other ends thereof to an end of the center axle 3. A plurality of channel members 9 are fixed at prescribed intervals between the pair of annular frames 8, with the flanges thereof directed toward the center of the annular frames 8. The lowermost ends of the cooling bodies 2 are replaceably fitted, by tightening bolts 10, at prescribed intervals (these intervals forming the cooling grooves 7), to the outer surfaces of the webs of the channel members 9. Thus, the barrel of the rotary drum 1 is formed, with the plurality of cooling grooves 7 on the outer surface thereof, formed by the mutually facing outer surfaces of two adjacent ones of the cooling bodies 2. As shown in FIG. 2, an annular closing plate 11 is fixed to each of the both ends of the plurality of cooling bodies 2 (the closing plate 11 only on one end is shown in FIG. 2), and thus, the both longitudinal ends of the plurality of cooling grooves 7 and the both longitudinal ends of the hollows for cooling water 2*a* of the plurality of cooling bodies 2 are closed by the pair of closing plates 11. Furthermore, the plurality of cooling grooves 7 are transversely divided into a plurality of compartments by partition plates 12.

As shown in FIG. 3, each of the cooling grooves 7 comprises an inlet section outwardly flaring, composed of two mutually facing opening surfaces 7*a* and 7*b* having a relatively large inclination angle against the vertical line, for introducing molten blast furnace slag, and a cooling section becoming narrower toward the depth thereof, immediately following said inlet section, composed of two mutually facing cooling surfaces 7*c* and 7*d* having a smaller inclination angle against the vertical line, for cooling and solidifying the molten blast furnace slag into a crystalline blast furnace slag.

As shown in FIG. 3, the bottom of each of the plurality of cooling grooves 7 having the above-mentioned structure is provided with a pushing board 13 having an inverse T-shaped cross-section, which comprises a rectangular plate 13*a* with a length substantially equal to the length of the cooling groove 7 and a stopper 13*b* serving also as a weight, fixed to an end of the plate 13*a*, in such a manner that the other end portion of the plate 13*a* is inserted into the cooling groove 7, and the end fixed with the stopper 13*b* projects from the inner surface of the barrel of the rotary drum 1. Each of the plurality of stoppers 13*b* has a length greater than the length of the plate 13*a* so as to actuate a stripper and a restorer described later. The tip portion of the other end of the plate 13*a* inserted into the cooling groove 7 is upset to have a slightly larger thickness, and a refractory piece 13*c* is built into the upset tip portion. The tip portion of the other end of the plate 13*a* thus forms the bottom surface of the cooling groove 7. As shown in FIG. 3, the pushing board 13 vertically slides in the cooling groove 7 along the depth thereof within the range of from the position where the upset tip portion of the other end of the plate 13*a* is pinched by the two facing cooling surfaces 7*c* and 7*d* of the cooling groove 7 up to the position where the stopper 13*b* comes into contact with the flange of the channel member 9. A notch (not shown) is provided in the portion of the plate 13*a* corresponding to the partition plate 12, so that the pushing board 13 vertically slides in the cooling groove 7 with no trouble.

FIG. 3 illustrates the state of the pushing board 12 when the cooling body 2 reaches, along with the rotation of the rotary drum 1, near the highest position of the barrel of the rotary drum 1, i.e., when the cooling groove 7 reaches the position for receiving the molten blast furnace slag (hereinafter referred to as the "positive position"). Near the positive position, the pushing board 13 is located at the lowest position. More specifically, near the positive position, the pushing board 13 lowers along the depth of the cooling groove 7 by the weight of the stopper 13*b* and/or by a restorer described later, and stops as the upset tip portion of the plate 13*a* of the pushihg board 13 is pinched by the two mutually facing cooling surfaces 7*c* and 7*d* composing the cooling section becoming narrower in the depth direction thereof. In this state, the cooling groove 7 has the greatest depth. On the other hand, when the cooling body 2 reaches, along with the rotation of the rotary drum 1, near the lower position of the barrel of the rotary drum 1, i.e., when the cooling groove 7 reaches the position for discharging the blast furnace slag solidifed therein (hereinafter referred to as the "reverse position"), the pushing board 13 is pushed into the cooling groove 7 by a stripper described later until the stopper 13 comes in contact with the flange of the channel member 9. In this state, the cooling groove 7 has the smallest depth.

The width of the upper end of the cooling section of the cooling groove 7 composed of the two mutually facing cooling surfaces 7*c* and 7*d* should preferably be within the range of from 40 to 80 mm, and the depth of the cooling section of the cooling groove 7 should preferably be within the range of from 100 to 300 mm at the positive position, i.e., when the pushing board 13 is at the lowest position. With an upper end width of the cooling section of the cooling groove 7 of under 40 mm, the cooling rate of the molten blast furnace slag becomes too high, and after solidification, there is produced a crystalline blast furnace slag containing large quantities of vitreous portions. The crystalline blast furnace slag containing large quantities of vitreous portions is not desirable because of, when crushed, the considerably high content of fine slag particles not suitable for a road subbase course material or a coarse aggregate for concrete. On the other hand, with a width of said upper end of over 80 mm, the interval between the cooling surfaces 7*c* and 7*d* becomes too large, the cooling rate of the molten blast furnace slag becomes low, and moreover, restricting force against expansion in the course of solidification of the molten blast furnace slag is small. As a result, yellow leaching liquid tends to be easily produced from the crystalline blast furnace slag after solidification. With a depth of the cooling section of the cooling groove 7 of under 100 mm, the small amount of treated molten blast furnace slag leads to a lower operating efficiency. On the other hand, a depth of the cooling section of the cooling groove 7 of over 300 mm is not practical because of the necessity of a very large rotary drum 1.

As shown in FIG. 1, a molten slag container 14 is arranged above the rotary drum 1. The molten slag container 14 receives a molten blast furnace slag 15 from a blast furnace (not shown) through a feeding trough 16. The molten blast furnace slag 15 received into the molten slag container 14 is poured into the cooling grooves 7 near the highest position of the barrel of the rotating rotary drum 1, i.e., at the positive position, through a pouring nozzle 14*a* provided at the bottom of the molten slag container 14. The top edge of the molten slag container 14 is provided with a discharging trough 17 for discharging excess molten blast furnace slag overflowing from the molten slag container 14 into a dry pit (not shown). A flow rate regulator 18 for adjusting the flow rate of the molten blast furnace slag 15 into the cooling grooves 7 from the molten slag container 14 is installed in the molten slag container 14. The flow rate regulator 18 may comprise, for example, a fixed plate, substantially horizontally fixed in the molten slag container 14, of an area equal to the cross-sectional area of the molten slag container 14, having a plurality of slits, and a shielding plate slightly smaller than the fixed plate, sliding on the fixed plate, having a plurality of slits in the number equal to that of the slits of the fixed plate. The total opening area of the slits of the fixed plate is increased or decreased by causing the shielding plate to slide on the fixed plate, thereby adjusting the flow rate of the molten blast furnace slag from the molten slag container 14 into the cooling grooves 7.

In FIG. 1, 37 is a gas supply means including a hood 19, fitted to the lower part of the molten slag container 14 above the rotary drum 1. The hood 19 is fitted to the lower part of the molten slag container 14 so as to isolate the space above the outer surface of the barrel being near the highest position of the rotary drum 1 below the molten slag container 14 from the other space. The interior of the hood 19 is equipped with a gas supply nozzle 20 for filling the hood 19 with such a shielding gas as an inert gas and a reducing gas. The interior of the hood 19 is therefore filled with such a shielding gas as an inert gas and a reducing gas, and thus, the molten blast furnace slag 15 discharged from the discharging nozzle 14*a* of the molten slag container 14 is shielded by an atmosphere comprising at least one of an inert gas and a reducing gas, during pouring of the molten blast furnace slag 15 into the cooling grooves 7 which reach the highest position of the barrel of the rotary drum 1 along with the rotation of the rotary drum 1.

In FIG. 1, 21 is a pair of strippers equipped each with a roller (not shown). The pair of strippers 21 are stationarily arranged, below the outside of the both sides of the rotary drum 1, one at each of positions where the pair of strippers are in contact with the lower surfaces of the both ends of the stopper 13*b* of the pushing board 13, projecting from the both sides of the rotary drum 1. The rollers of the pair of strippers 21 push the pushing boards 13, in contact with the stopper 13*b* of the pushing board 13 near the reverse position of the rotary drum 1 during rotation, into the cooling grooves 7, until the stoppers 13*b* come into contact with the flange of the channel member 9. As a result, a cooled and solidified crystalline blast furnace slag 23 in the cooling grooves 7 is pushed out from the cooling grooves 7 and discharged.

In FIG. 1, 22 is a transporting belt conveyor, of which the base portion is arranged below the rotary drum 1, for transporting the crystalline blast furnace slag 23 discharged from the cooling grooves 7 to a prescribed place. The cooled and solidified crystalline blast furnace slag 23 in the cooling grooves 7 is pushed out from the cooling grooves 7 by the pair of strippers 21 and falls onto the base portion of the transporting belt conveyor 22. In FIG. 1, 24*a* and 24*b* are sand feed troughs having a width at least substantially equal to the length of the cooling groove 7, for feeding wet sand 30 from a wet sand feeder (not shown) onto the transporting belt conveyor 22, installed as required. The sand feed trough 24*a* is arranged so that the sand supply end thereof is located between the lower part of the barrel of the rotary drum 1 and the base portion of the transporting belt conveyor 22. Therefore, wet sand 30 from the sand feed trough 24*a* is fed onto the transporting belt conveyor 22 at the base portion thereof, and thus, the crystalline blast furnace slag 23 pushed out from the cooling grooves 7 falls onto the wet sand 30 on the transporting belt conveyor 22. The sand feed trough 24*b* is arranged so that the sand supply end thereof is located above the transporting belt conveyor 22 at a prescribed position in the downstream of the base portion of the transporting belt conveyor 22. Therefore, the crystalline blast furnace slag 23 fallen onto the transporting belt conveyor 22 and transported from the base portion thereof is entirely covered by the wet sand 30 by the supply of the wet sand 30 from the sand feed trough 24*b*. As a result, since the crystalline blast furnace slag 23 falling onto the transporting belt conveyor 22 still has a high temperature to some extent, complete coverage thereof by the wet sand 30 causes production of cracks in the vitreous portions formed on the surface thereof. Thus, it is easy to eliminate vitreous portions formed on the surface of the crystalline blast furnace slag 23, when using as a coarse aggregate for concrete by crushing. The treating amount of molten blast furnace slag 15 can be increased by employing the sand feed troughs 24*a* and 24*b*. More specifically, by increasing the flow rate per unit time from the pouring nozzle 14*a* of the molten slag container 14 by the flow rate regulator 18, and by carrying out operation while keeping the same operational conditions except for an increased rotating speed of the rotary drum 1, the blast furnace slag in a state in which solidification is not as yet completed to the interior falls onto the transporting belt conveyor 22. However, because said blast furnace slag is cooled by the wet sand on the transporting belt conveyor 22, it is possible to take out a crystalline blast furnace slag in a state in which solidification has been substantially complete to the interior.

Figure 4:
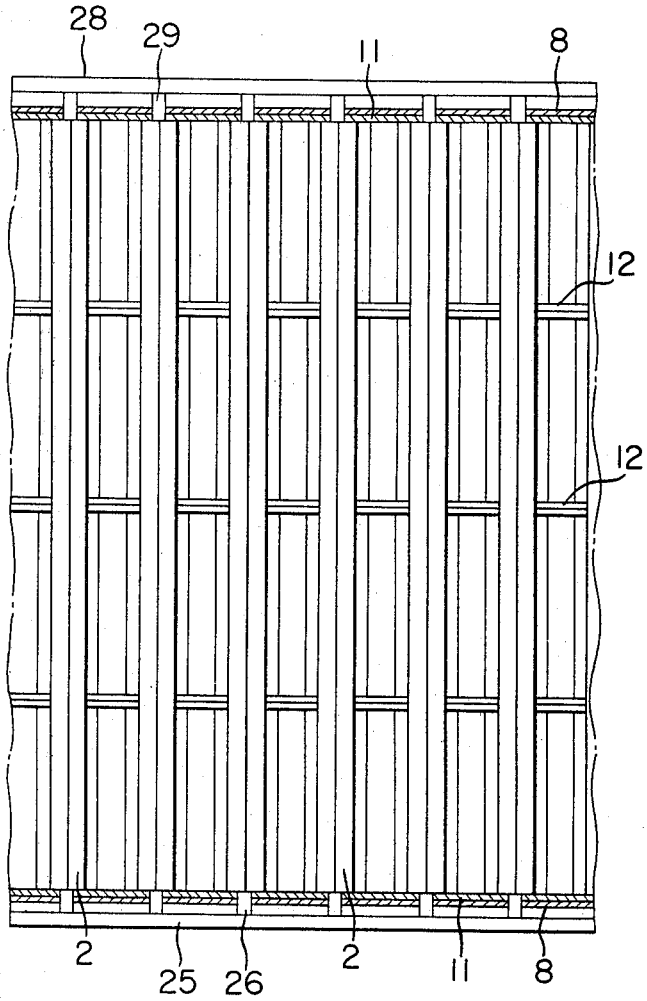
FIG. 4 is a plan view illustrating a part of the barrel of the rotary drum which is one of the constituent components of the apparatus for manufacturing a crystalline blast furnace slag of the present invention.

FIG. 4 is a plan view illustrating a part of the barrel of the rotary drum 1. As shown in FIGS. 1 and 4, an annular pipe for supplying cooling water 25 is fixed to the outside of a side of the rotary drum 1 along the circumference thereof. The annular pipe for supplying cooling water 25 water-tightly communicates, through a short supply pipe 26, with each of the hollows for cooling water 2*a* of the plurality of cooling bodies 2 on one side thereof. The inside of the hollow center axle 3 of the rotary drum 1 is divided into two at about the middle thereof, and the annular pipe for supplying cooling water 25 water-tightly communicates, through a connecting pipe 27, with the interior of the center axle 3 on one side thereof. The interior of the center axle 3 on the one side thereof water-tightly communicates, through an external cooling water supply pipe (not shown), with a cooling water source (not shown). Therefore, cooling water from the cooling water source (not shown) is supplied into each of the hollows for cooling water 2*a* through the external cooling water supply pipe (not shown), the interior of the center axle 3 on the one side thereof, the connecting pipe 27, the annular pipe for supplying cooling water 25 and the short supply pipe 26. As shown in FIG. 4, on the other hand, an annular pipe for discharging cooling water 28 is fixed to the outside of the other side of the rotary drum 1 along the circumference thereof. The annular pipe for discharging cooling water 28 water-tightly communicates, through a short discharge pipe 29, with each of the hollows for cooling water 2*a* of the plurality of cooling bodies 2 on the other side thereof. The annular pipe for discharging cooling water 28 water-tightly communicates, through another connecting pipe (not shown), with the interior of the center axle 3 on the other side thereof. The interior of the center axle 3 on the other side thereof water-tightly communicates, through an external cooling water discharge pipe (not shown), with the cooling water source (not shown). Therefore, cooling water supplied into each of the hollows for cooling water 2*a* is discharged therefrom to the cooling water source (not shown), through the short discharge pipe 29, the annular pipe for discharging cooling water 28, the other connecting pipe (not shown), the interior of the center axle 3 on the other side thereof and the external cooling water discharge pipe (not shown). Thus, the plurality of cooling bodies 2 are cooled by cooling water.

In FIG. 1, 31 are a pair of restorers of the pushing boards 13, installed as required. The pair of restorers 31 are stationarily arranged, outside the both sides of the rotary drum 1 and in the downstream of the above-mentioned pair of strippers 21 relative to the rotating direction of the rotary drum 1, one at each of positions where the pair of restorers 31 are adjacent to the lower surfaces of the both ends of the stopper 13*b* of the pushing board 13, projecting from the both sides of the rotary drum 1. The pair of restorers 31 pull out the pushing board 13 which has been pushed into the cooling groove 7 by the pair of strippers 21, to the lowest position, i.e., the receiving position of molten blast furnace slag. The restorer 31 comprises, for example, a magnet, and pulls out the pushing board 13 under the effect of magnetism of the magnet to the lowest position. In this case, therefore, at least a part of the stopper 13*b* of the pushing board 13 should be made of a magnetizable material such as steel. When the stopper 13*b* is made of a non-magnetizable material such as silicon carbide, the restorer 31 may be made so as to mechanically pull out the pushing board 13.

A crystalline blast furnace slag is manufactured as follows by the apparatus for manufacturing a crystalline blast furnace slag of the present invention having the structure as mentioned above. More specifically, as shown in FIG. 1, a molten blast furnace slag 15 in the molten slag container 14 is poured through the pouring nozzle 14*a* into the cooling groove 7 reaching near the highest position of the barrel of the rotary drum 1 rotating in the arrow direction in the drawing, i.e., near the position for receiving molten blast furnace slag, in an atmosphere of such shielding gas as an inert gas and a reducing gas, cooled and solidified with the expansion thereof being restricted by the two mutually facing cooling surfaces 7*c* and 7*d* composing the cooling section of the cooling groove 7, and becomes substantially completely a-crystalline blast furnace slag 23 before being pushed out from the cooling groove 7 by the pair of strippers 21. Then, along with the rotation of the rotary drum 1, when the cooling groove 7 filled with the crystalline blast furnace slag reaches near the lowest position of the barrel of the rotary drum 1, the pushing board 13 on the bottom of the cooling groove 7 is pushed into the cooling groove 7 by the pair of strippers 21, and thus, the cooled and solidified crystalline blast furnace slag 23 in the cooling groove 7 is pushed out from the cooling groove 7, falling onto the transporting belt conveyor 22. Since the cooling bodies 2 are always cooled by cooling water, the temperature of the cooling bodies 2 is decreased to a level allowing cooling and solidification of the molten blast furnace slag before the cooling bodies 2 reach the top of the barrel of the rotary drum 1, after the crystalline blast furnace slag 23 is taken out.

As mentioned above, when the cooling groove 7 having become empty after discharge of the crystalline blast furnace slag 23 reaches the position, where the pair of restorers 31 are installed, along with the rotation of the rotary drum 1, the pushing board 13 is withdrawn by the pair of restorers 31 to the lowest position, i.e., to the position for receiving molten blast furnace slag. When the cooling groove 7 reaches again near the highest point of the barrel of the rotary drum 1 along with the rotation of the rotary drum 1, a molten blast furnace slag is poured into the cooling groove 7 as mentioned above, and thus, manufacture of the crystalline blast furnace slag is continuously carried out.

Figure 5:
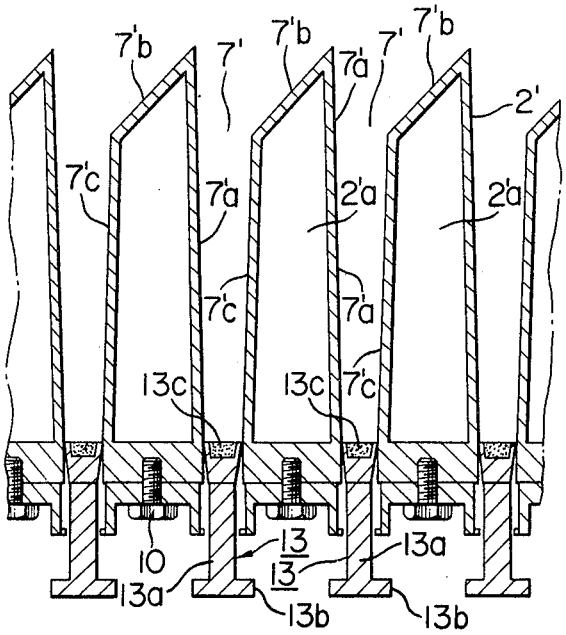
FIG. 5 is a schematic sectional view illustrating another embodiment of a part of the barrel of the rotary drum which is one of the constituent components of the apparatus for manufacturing a crystalline blast furnace slag of the present invention.

The cooling body 2 described above with reference to FIGS. 2 and 3 may be replaced by another cooling body 2′ shown by the schematic sectional view of FIG. 5, made of the same material as that of the above-mentioned cooling body 2. The only difference between the cooling body 2 described above with reference to FIGS. 1 to 4 and the cooling body 2′ shown in FIG. 5 lies in the top shape. More specifically, the top of the cooling body 2 shown in FIGS. 1 to 4 is formed by the two opening surfaces 7*a* and 7*b* having identical sides and identical inclination angles. In contrast, the top of the cooling body 2′ shown in FIG. 5 is formed by a flat surface 7′*a* shown on the right in the drawing, and an opening surface 7′*b* having a relatively large inclination angle against the vertical line, shown on the left in the drawing.

As in the above-mentioned cooling body 2, each of a plurality of cooling grooves 7′ formed on the outer surface of the rotary drum 1 by endlessly connecting at prescribed intervals a plurality of cooling bodies 2′ comprises an outwardly flaring inlet section for introducing a molten blast furnace slag, and a cooling section becoming narrower in the depth direction, immediately following said inlet section, for cooling and solidifying the molten blast furnace slag into a crystalline blast furnace slag. The above-mentioned inlet section is formed by the upper portion of the flat surface 7′*a* and the opening surface 7′*b*, which face to each other. The above-mentioned cooling section is formed by the lower portion of the flat surface 7′*a* and a cooling surface 7′*c* having a relatively small inclination angle against the vertical line, following the opening surface 7′*b*, which face to each other.

Figure 6:
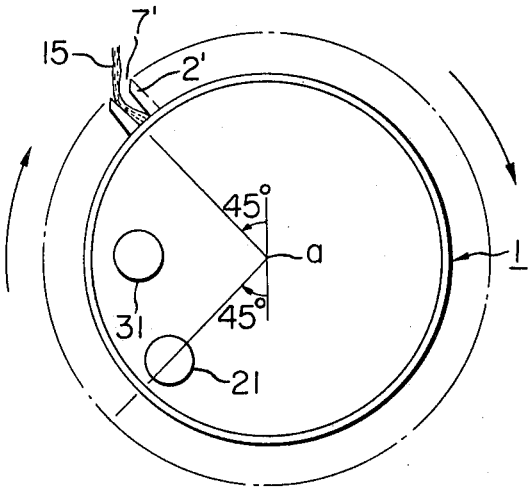
FIG. 6 is a schematic sectional view illustrating the pouring position of a molten blast furnace slag into the rotary drum having the barrel shown in FIG. 5.

When using the cooling bodies 2′ shown in FIG. 5, it is possible to change the pouring position of a molten blast furnace slag to a position in the upstream in the rotating direction of the rotary drum 1 relative to the pouring position of the molten blast furnace slag described above with reference to FIG. 1. More particularly, as shown in the schematic sectional view of FIG. 6, it is possible to pour the molten blast furnace slag 15 into the cooling groove 7′ at a position in the upstream in the rotating direction of the rotary drum 1 by a central angle of about 45° at the center "a" of the rotary drum 1, as measured from the highest position of the barrel of the rotary drum 1. In this case, the molten blast furnace slag 15 is poured into the cooling groove 7′ along the flat surface 7′*a* inclining by about 45° against the vertical line, thus minimizing entanglement of such shielding gases as an inert gas and a reducing gas into the molten blast furnace slag 15. As shown in FIG. 6, it is possible to arrange the pair of strippers 21 at a place in the downstream in the rotating direction of the rotary drum 1 by a central angle of about 45° at the center of the rotary drum 1, as measured from the lowest position of the barrel of the rotary drum 1. With the same rotating speed of the rotary drum 1, therefore, the molten blast furnace slag 15 stays longer in the cooling groove than in the case of the apparatus for manufacturing a crystalline blast furnace slag shown in FIG. 1. As a result, since the time from the pouring of the molten blast furnace slag into the cooling groove up to achievement of a prescribed state of solidification of the blast furnace slag in the cooling groove is independent of the rotation speed of the rotary drum 1, it is possible to obtain, in the apparatus shown in FIG. 6, a crystalline blast furnace slag solidified substantially up to the interior thereof, even with a higher rotating speed of the rotary drum 1, as compared with the apparatus shown in FIG. 1, thus permitting achievement of a higher manufacturing efficiency.

Figure 7:
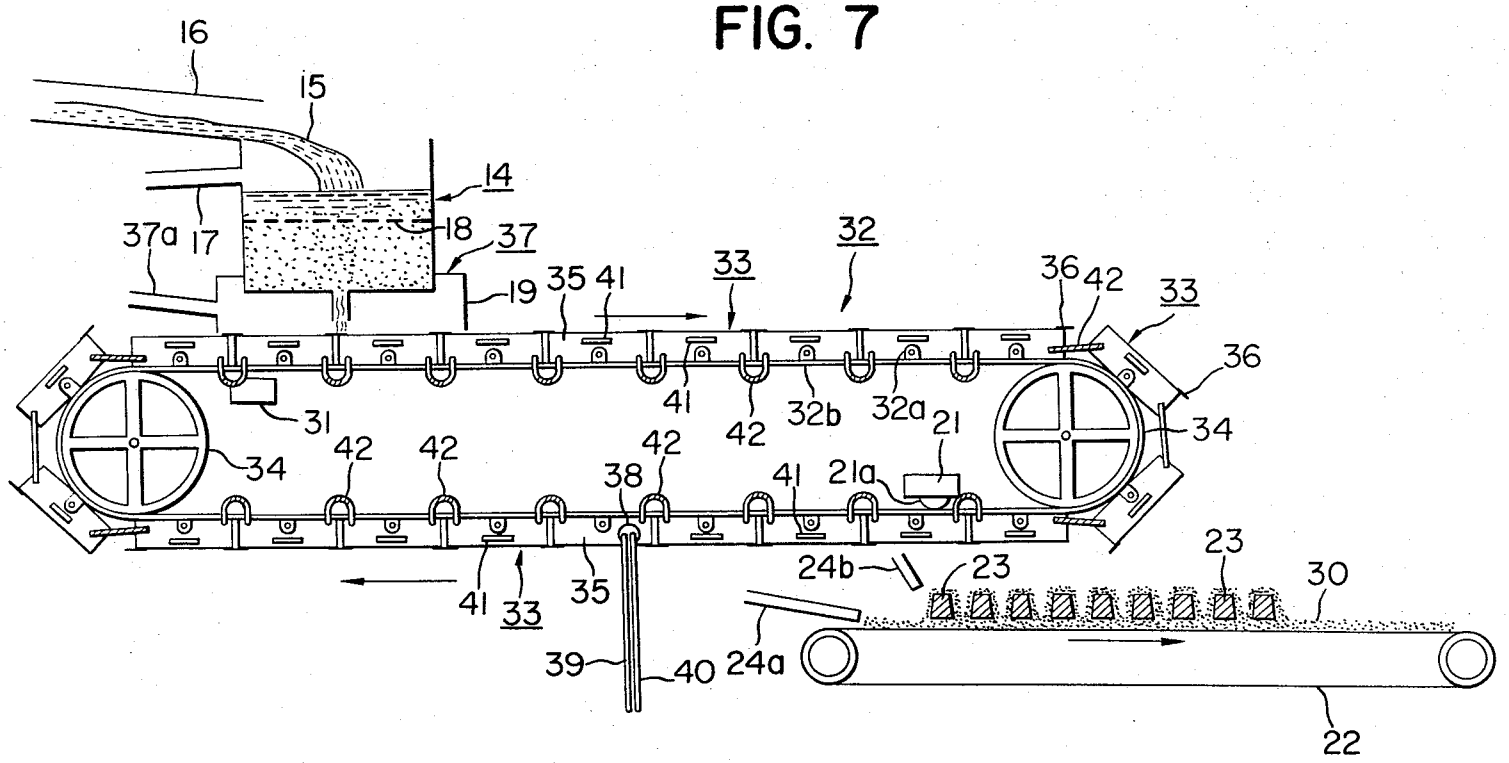
FIG. 7 is a schematic sectional view illustrating another embodiment of the apparatus for manufacturing a crystalline blast furnace slag of the present invention.

FIG. 7 is a schematic sectional view illustrating another embodiment of the apparatus for manufacturing a crystalline blast furnace slag of the present invention. In FIG. 7, 32 is an endless conveyor belt; 33 are a plurality of rectangular cooling metal members forming the endless conveyor belt 32; and, 34 are a pair of pulleys for moving the endless conveyor belt 32.

As shown in FIG. 7, the endless conveyor belt 32 comprises the plurality of endlessly connected cooling metal members 33, supporting plates 32*a* supporting each of the plurality of cooling metal members 33 on the both sides thereof, and a belt 32*b* engaging with the pair of pulleys 34 fixed with the supporting plates 32*a*. Although omitted in FIG. 7 for simplification of the drawing, the endless conveyor belt 32 is supported by a plurality of support rollers. At least one pulley 34 is driven by a driving means (not shown), whereby the endless conveyor belt 32 travels at a prescribed speed in the arrow direction in FIG. 7. Each of the plurality of cooling metal members 33 has, on the outer surface thereof, a plurality of narrow and deep cooling grooves, formed as mentioned later, extending substantially transversely to the traveling direction of the endless conveyor belt 32.

Figure 8:
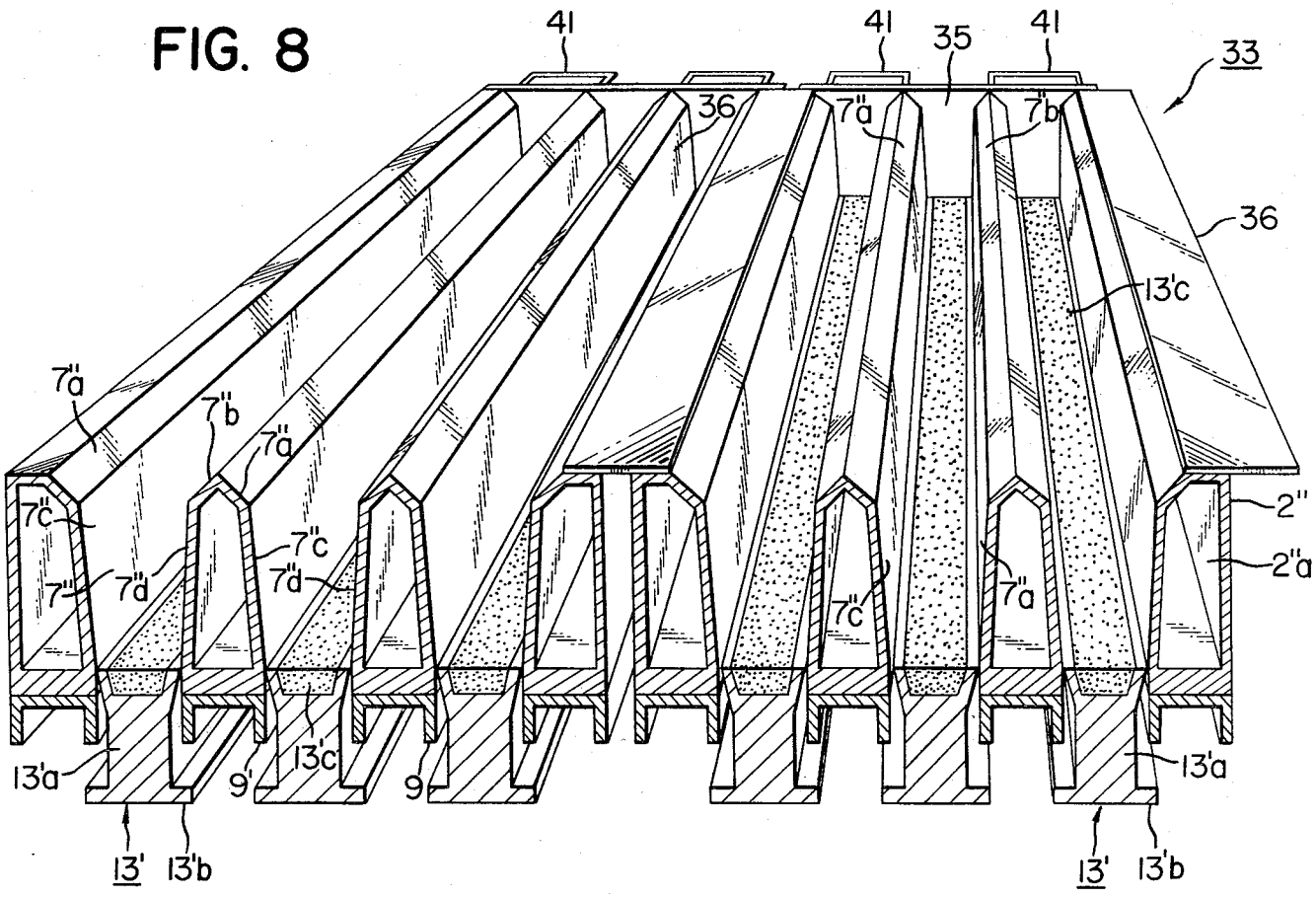
FIG. 8 is a partially cutaway perspective view illustrating an embodiment of the cooling metal member which is one of the constituent components of the apparatus for manufacturing a crystalline blast furnace slag of the present invention shown in FIG. 7; and, FIG. 9 is a graph illustrating the results of a yellow scale test of the crystalline blast furnace slag manufactured by the apparatus for manufacturing a crystalline blast furnace slag of the present invention.

FIG. 8 is a partially cutaway schematic perspective view illustrating an embodiment of the cooling metal member 33. As shown in FIG. 8, the cooling metal member 33 comprises a plurality of cooling bodies 2″ each with a hollow for cooling water 2″*a* therein substantially identical with the cooling bodies 2 described above with reference to FIGS. 1 to 4. The plurality of cooling bodies 2″ are fixed at prescribed intervals (these intervals forming a plurality of cooling grooves 7″) to a pair of closing plates 35 having a height to close the hollows for cooling water 2″*a* at the both longitudinal end portions of the cooling bodies 2″, whereby the rectangular cooling metal member 33 having the plurality of cooling grooves 7″ on the outer surface thereof is formed.

As shown in FIG. 8, each of the cooling grooves 7″ has substantially the same structure as that of the above-mentioned cooling groove 7, and comprises an inlet section composed of opening surfaces 7″*a* and 7″*b* and a cooling section composed of cooling surfaces 7″*c* and 7″*d*.

As shown in FIGS. 7 and 8, from among the plurality of cooling bodies 2″ composing the cooling metal member 33, the upper surface of the cooling body 2″ located at the downstream end in the moving direction of the endless conveyor belt 32, is fitted with a slag stopper plate 36 so as to prevent a molten slag poured from a molten slag container described later from falling between the two adjacent cooling metal members 33.

As shown in FIG. 8, the bottom of each of the plurality of cooling grooves 7″ having the above-mentioned structure is equipped with a pushing board 13′ having substantially the same structure as the pushing board 13 described above with reference to FIGS. 2 and 3 in substantially the same state as that in which the pushing board 13 is fitted to the cooling groove 7. In FIG. 8, 13′*a* is a rectangular plate; 13′*b* is a stopper; 13′*c* is a refractory piece; and 9′ is a channel member fixed to the lower surface of the cooling body 2″ by tightening bolts (not shown). The stopper 13′*b* has a length substantially equal to the length of the plate 13′*a*. As shown in FIG. 8, the pushing board 13′ slides up and down in the cooling groove 7″ along the depth direction of the cooling groove 7″ within the range from a position where the upset tip portion of the end of the plate 13′*a* inserted into the lower portion of the cooling groove 7″ is pinched by the two mutually facing cooling surfaces 7″*c* and 7″*d* of the cooling groove 7″, to a position where the stopper 13′*b* comes into contact with the flange of the channel member 9′.

FIG. 8 represents the state of the pushing board 13′ when the cooling metal member 33 reaches the upper forwarding position of the endless conveyor belt 32, i.e., when the plurality of cooling grooves 7″ of the cooling metal member 33 reach the position with openings thereof directed upward (hereinafter referred to as the "positive position") along with the travel of the endless conveyor belt 32. At the positive position, the pushing board 13′ is located at the lowest position. In this state, the cooling groove 7″ is deepest and can receive a molten blast furnace slag. On the other hand, when the cooling metal member 33 reaches the lower returning position of the endless conveyor belt 32, i.e., when the plurality of cooling grooves 7″ of the cooling metal member 33 reach the position with openings thereof directed downward (hereinafter referred to as the "reverse position") along with the travel of the endless conveyor belt 32, the pushing board 13′ is pushed into the cooling groove 7″ by a stripper described later until the stopper 13′*b* comes into contact with the flange of the channel member 9′. In this state, the depth of the cooling groove 7 is smallest.

The width of the upper end of the cooling section of the cooling groove 7″ composed of the two mutually facing cooling surfaces 7″*c* and 7″*d* should preferably be within the range of from 40 to 80 mm, and the depth of the cooling section of the cooling groove 7″ should preferably be within the range of from 100 to 300 mm at the positive position, i.e., when the pushing board 13′ is at the lowest position. The reasons are the same as the reasons described above with regard to the cooling groove 7.

As shown in FIG. 7, the molten slag container 14 described above with reference to FIG. 1 is arranged above the upstream of the upper forwarding position of the endless conveyor belt 32. In FIG. 7, 37 is a gas supply means including a hood 19, fitted to the lower part of the molten slag container 14 above the endless conveyor belt 32. The hood 19 is fitted to the lower part of the molten slag container 14 so as to isolate the space above the upstream of the upper forwarding position of the endless conveyor belt 32 from the other space. As shown in FIG. 7, the interior of the hood 19 is equipped with a gas supply pipe 37*a* for supplying a shielding gas such as an inert gas and a reducing gas into the hood 19. The interior of the hood 19 is therefore filled with such a shielding gas as an inert gas and a reducing gas, and thus, the molten blast furnace slag 15 received into the molten slag container 14 is poured, in an atmosphere of the shielding gas, into the cooling grooves 7″ of the cooling metal member 33 at the positive position from among the plurality of cooling metal members 33 forming the endless conveyor belt 33 during movement, through a pouring nozzle 14*a* provided in the bottom of the molten slag container 14.

As shown in FIg. 7, the stripper 21 provided with rollers 21*a* described above with reference to FIG. 1 is arranged, in the upstream of the lower returning position of the endless conveyor belt 32, adjacent to the back surface of the cooling metal member 33 at the reverse position. The stripper 21 is stationarily held at a prescribed position by a support (not shown) such as a boom. The rollers 21*a* of the stripper 21 push the plates 13′*a*, in contact with the stoppers 13′*b* of the pushing boards 13′ of the cooling metal member 33 at the reverse position, into the cooling grooves 7″, until the stoppers 13′*b* come into contact with the flange of the channel member 9′ fixed to the lower surface of the cooling bodies 2″ forming the cooling grooves 7″. As a result, a cooled and solidified crystalline blast furnace slag 23 in the cooling grooves 7″ is pushed out from the cooling grooves 7″ and falls onto the transporting belt conveyor 22, described above with reference to FIG. 1, with the base portion arranged below the upstream of the lower returning position of the endless conveyor belt 32. In FIG. 7, 24*a* and 24*b* are the sand feed troughs, installed as required, described above with reference to FIG. 1. The sand feed troughs 24*a* and 24*b* have a width at least substantially equal to the length of the cooling groove 7″. The sand feed troughs 24*a* and 24*b* are arranged so that the sand supply ends thereof are located below the endless conveyor belt 32 and above the base portion of the transporting belt conveyor 22. Therefore, a crystalline blast furnace slag 23 pushed out from the cooling grooves 7″ and having fallen onto the transporting belt conveyor 22 is entirely covered by the wet sand 30, and transported to a prescribed place by the transporting belt conveyor 22.

As shown in FIG. 7, a coaxial type pipe holder 38 having a double-pipe structure is rotatably attached to the closing plate 35 of one of the cooling metal members 33. A flexible external cooling water supply pipe 39, connected to a cooling water source (not shown), for supplying cooling water to each of the hollows for cooling water 2″*a* of the plurality of cooling bodies 2″ of the plurality of cooling metal members 33, and a flexible external cooling water discharge pipe 40 for discharging cooling water after cooling all the cooling bodies 2″, are connected to the pipe holder 38. Since the external cooling water supply pipe 39 and the external cooling water discharge pipe 40 are flexible, travelling of the endless conveyor belt 32, i.e., travelling of the plurality of cooling metal members 33 is effected with no trouble. The pipe holder 38 comprises a fixed portion, having a double-pipe structure, fixed to the closing plate 35, and a rotating portion rotatably fitted to the fixed portion. The external cooling water supply pipe 39 and the external cooling water discharge pipe 40 are fixed to the rotating portion. As shown in FIG. 8, a plurality of connecting pipes 41 each for permitting water-tight communication between two adjacent hollows for cooling water 2″*a* of the cooling bodies 2″ of the cooling metal member 33, are fixed to the outside of each of the pair of closing plates 35 on the both sides of the cooling metal member 33 (the closing plate 35 only on one side being illustrated in the drawing). Furthermore, as shown in FIG. 7, a flexible liaison pipe 42 for permitting water-tight communication between the hollows for cooling water 2″*a* of two most closely adjacent cooling bodies 2″ of the two adjacent cooling metal members 33, is provided between the closing plates 35 of the two adjacent cooling metal members 33. Therefore, cooling water from the cooling water source (not shown) is introduced through the external cooling water supply pipe 39 and the pipe holder 38 into the hollow for cooling water 2″*a* of one of the cooling bodies 2″ of one of the cooling metal members 33, then passes sequentially through the hollows for cooling water 2″*a* of the cooling bodies 2″ of this cooling metal member 33 via the connecting pipes 41, then is introduced through the liaison pipe 42 into the hollow for cooling water 2″*a* of the first cooling body 2″ of the following cooling metal member 33, then passes sequentially through the hollows for cooling water 2″*a* of the cooling bodies 2′ of this cooling metal member 33 via the connecting pipe 41, and thus, after cooling all the cooling bodies 2″ of all the cooling metal members 33, is discharged to outside through the pipe holder 38 and the external cooling water discharge pipe 40.

As shown in FIG. 7, the restorer 31, installed as required, described above with reference to FIG. 1, is arranged adjacent to the back surface of the cooling metal member 33 at the positive position on the upstream side of the pouring nozzle 14*a* of the molten slag container 14 in the upper forwarding position of the endless conveyor belt 32. The restorer 31 is stationarily held at a prescribed position by a support (not shown) such as a boom. The restorer 31 pulls out the pushing board 13″ which has been pushed into the cooling groove 7″ by the stripper 21 to the lowest position, i.e., the receiving position of molten blast furnace slag 15. Although only one restorer 31 may be installed, it is desirable to arrange at least two restorers 31 from safety considerations, because insufficient withdrawal of the pushing board 13″, if any, may be dangerous.

A crystalline blast furnace slag is manufactured as follows by means of the apparatus for manufacturing a crystalline blast furnace slag of the present invention having the structure as mentioned above. More specifically, as shown in FIG. 7, a molten blast furncace slag 15 received in the molten slag container 14 through the feeding trough 16 from a blast furnace (not shown) is poured through the pouring nozzle 14*a*, in an atomosphere of a shielding gas such as an inert gas and a reducing gas, sequentially into the cooling grooves 7″ of the cooling metal member 33 at the positive position (i.e., at the position for receiving molten blast furnace slag) reaching the upstream of the upper forwarding position of the endless conveyor belt 32 during travelling in the arrow direction in the drawing, and cooled and solidified by the mutually facing cooling surfaces 7″*c* and 7″*d* composing the cooling section of the cooling groove 7″ into a substantially completely crystallized blast furnace slag before falling onto the transporting belt conveyor 22.

Then, along with the travel of the endless conveyor belt 32, when the cooling metal member 33 filled with the solidified crystalline blast furnace slag reaches the upstream of the lower returning position of the endless conveyor belt 32 (the cooling metal member being at the reverse position), the plate 13′*a* of the pushing board 13′ of the cooling metal member 33 is pushed into the cooling groove 7″ by the stripper 21, and thus, the cooled and solidified crystalline blast furnace slag 23 in the cooling groove 7″ is pushed out from the cooling groove 7″, falling onto the transporting belt conveyor 22. Since the cooling bodies 2″ are always cooled by cooling water, the cooling bodies 2″ can have a temperature permitting cooling and solidification of the molten blast furnace slag, after removal of the crystalline blast furnace slag 23, before reaching the upstream of the upper forwarding position of the endless conveyor belt 22.

Then, when the cooling metal member 33, which has become empty after discharge of the crystalling blast furnace slag 23, reaches, along with the travel of the endless conveyor belt 32, the upsteam of the upper forwarding position of the endless conveyor belt 32 (the cooling metal member 33 having returned to the positive position), the pushing board 13′ of the cooling metal member 33 is withdrawn by the restorer 31 to the lowest position i.e., to the position for receiving molten blast furnace slag. When the cooling metal member 33 reaches again the position where the molten slag container 14 is installed along with the travel of the endless conveyor belt 32, a molten blast furnace slag is poured into the cooling grooves 7'' of the cooling metal member 33 as mentioned above, and thus, manufacture of a crystalline blast furnace slag is continuously carried out.

Now, the method and the apparatus for manufacturing a crystalline blast furnace slag of the present invention is described in more detail by means of examples.

EXAMPLE 1

An endless conveyor belt 32 with a wheel base between two pulleys 34 and 34 of 8.0 m as shown in FIG. 7 was formed by endlessly connecting cooling metal members 33 made of steel having a structure as described above with reference to FIG. 8. The outer surface of each of the cooling metal members 33 was provided with eight cooling grooves 7'' having a length of 1 m, each comprising an inlet section and a cooling section and extending substantially transversely to the travelling direction of the endless conveyor belt 32. The top end of the cooling section of each of the cooling grooves 7'' has a width of 50 mm; the bottom surface of the cooling section had a width of 30 mm; when the pushing board 13' was at the lowest position and the cooling section had a depth of 300 mm when the pushing board 13' was at the lowest position.

Then, molten blast furnace slag 15 in the molten slag container 14 was poured, in an $N_2$ gas atmosphere at a pouring temperature of 1,310° C., through the pouring nozzle 14*a* into the cooling groove 7'' of the cooling metal member 33 having reached the upstream of the uppr forwarding position of the endless conveyor belt 32, thus taking the positive position, i.e., the receiving position of molten blast furnace slag, so that the cooling section was substantially filled with the poured molten blast furnace slag 15, while moving the endless conveyor belt 32 at a speed of 4.0 m per minute by driving one of the pulleys 34 by means of a driving means (not shown). The poured molten blast furnace slag 15 was cooled and solidified by the two mutually facing cooling surfaces 7''*c* and 7''*d* composing the cooling section of the cooling groove 7'' into a substantially completely crystallized blast furnace slag.

Then, when the cooling metal member 33 filled with the solidified crystalline blast furnace slag 23 reached the upstream of the lower returning position of the endless conveyor belt 32, along with the travel of the endless conveyor belt 32, the pushing board 13' of the cooling metal member 33 at the reverse position was pushed by the stripper 21 into the cooling groove 7'', whereby the crystalline blast furnace slag 23 cooled and solidified in the cooling groove 7'' was pushed out from the cooling groove 7'', fell onto the transporting belt conveyor 22, and transported to a prescribed place by the transporting belt conveyor 22.

On the other hand, when the empty cooling metal member 33 at the reverse position reached the installation position of the restorer 31 in the upstream of the upper forwarding position of the endless conveyor belt 32 along with the travel of the endless conveyor belt 32 (the cooling metal member 33 having returned to the positive position at this moment), the pushing board 13' of the cooling metal member 33 was withdrawn by the restorer 31 to the lowest position, i.e., to the receiving position of molten blast furnace slag, and thus, the cooling metal member 33 returned to the state of receiving the next batch of molten blast furnace slag. At this moment, the cooling body 2'' of the cooling metal member 33 was cooled to a temperature capable of cooling and solidifying the molten blast furnace slag.

Then, operation was carried out on the above-mentioned apparatus under the same conditions except that the pouring temperature of molten blast furnace slag into the cooling groove 7'' was changed to 1,400° C. and 1,440° C., and a crystalline blast furnace slag 23 solidified substantially completely up to the interior thereof was obtained at the end of the transporting belt conveyor 22.

A yellow scale test was carried out on each of the three different kinds of crystalline blast furnace slag manufactured with different pouring temperatures of the molten blast furnace slag into the cooling groove 7'', obtained as mentioned above with the use of the apparatus of the present invention. More specifically, the three kinds of crystalline blast furnace slag mentioned above were respectively crushed to the particle size range of from 5 to 25 mm. Then, each of respective samples taken out each in an amount of 100 g from the three kinds of crystalline blast furnace slag of which the particle size was thus adjusted, was placed in a 1-l beaker, added with 300 ml of distilled water, covered with a watch glass and heated. Distilled water in the beaker was boiled 15 minutes after starting heating, then further boiled for 45 minutes, and filtered before reaching the ambient temperature to take the filtrate in a test tube. Then, by comparing the color of each filtrate thus obtained with colors of a plurality of reference liquids prepared from aqueous solutions of potassium bichromate known as yellow scale indices as shown in Table 1, the yellow scale index of the reference liquid having the closest color was recorded as the yellow scale index for said filtrate. The results of the above-mentioned yellow scale test are shown in FIG. 9.

TABLE 1

| Yellow scale index | Color | Light absorptivity | Concentration of potassium bichromate (g/l) |
|---|---|---|---|
| 0 | Colorless | Under 0.045 | 0.002 |
| 0.5 | Almost colorless | 0.045 to under 0.10 | 0.004 |
| 1.0 | Very light lemon-yellow | 0.10 to under 0.15 | 0.0085 |
| 1.5 | Light lemon-yellow | 0.15 to under 0.23 | 0.0145 |
| 2.0 | Slight lemon-yellow | 0.23 to under 0.35 | 0.025 |
| 2.5 | Lemon-yellow | 0.35 to under 0.51 | 0.042 |
| 3.0 | Yellow | 0.51 to under 0.78 | 0.076 |
| 3.5 | Slight dark yellow | 0.78 to under 1.20 | 0.135 |
| 4.0 | Dark yellow | 1.20 to under 1.70 | 0.235 |
| 4.5 | Blackish dark yellow | 1.70 to under 2.60 | 0.375 |
| 5.0 | Brown | 2.60 and over | 0.45 |

Figure 9:
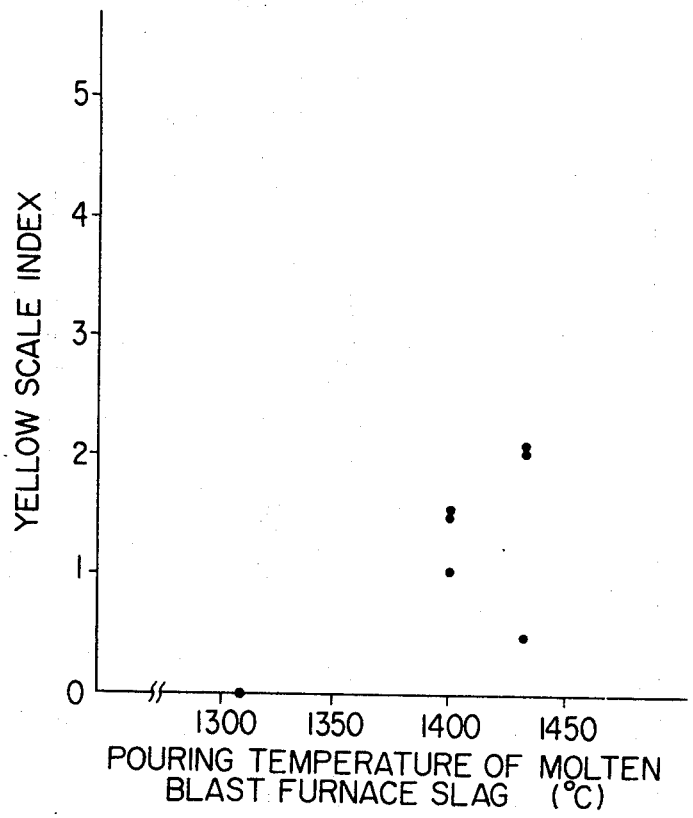

FIG. 9 demonstrates that a crystalline blast furnace slag with a yellow scale index of zero, i.e., giving almost no yellow leaching liquid, can be manufactured by using a pouring temperature of a molten blast furnace slag into the cooling groove 7'' of up to 1,350° C.

Then, out of the three kinds of crystalline blast furnace slag mentioned above, samples of the crystalline blast furnace slag manufactured by pouring a molten blast furnace slag into the cooling groove 7'' at a temperature of 1,310° C. were left in a wet atmosphere respectively for 7 days, 14 days and 21 days from the manufacture thereof. The above-mentioned yellow scale test was carried out on each of the samples of the crystalline blast furnace slags thus obtained after the respective periods of time, and as a result, all the samples showed a yellow scale index of zero. Therefore, these crystalline blast furnace slags having a yellow scale index of zero were found to be most suitable as a road subbase course material. Especially, three samples arbitrarily taken from the crystalline blast furnace slag left for 21 days showed very small values of light absorptivity of the filtrates of 0.009, 0.008 and 0.006 in the yellow scale test.

EXAMPLE 2

A crystalline blast furnace slag (hereinafter referred to as the "slag of the present invention") was manufactured with the use of the same apparatus and under the same conditions as in the Example 1 except that a molten blast furnace slag was poured into the cooling groove 7" at a pouring temperature of 1,350° C. The slag of the present invention thus obtained and a conventional slow-cooled blast furnace slag were crushed and subjected to particle size adjustment so as to fall into the size range for the blast furnace slag coarse aggregate for concrete as set forth in JIS (the Japanese Industrial Standards) A 5011. On the conventional slow-cooled blast furnace slag and the slag of the present invention thus subjected to particle size adjustment, physical properties were investigated as the blast furnace slag coarse aggregate for concrete as set forth in JIS A 5011. The results are given in Table 2. In Table 2, the values of physical properties of blast furnace slag coarse aggregates for concrete ranked as Classes A and B in JIS A 5011 are also indicated.

TABLE 2

| | Absolute density | Water absorption (%) | Unit weight (kg/l) |
|---|---|---|---|
| JIS A 5011 Class A | 2.2 and over | 6 and under | 1.25 and over |
| JIS A 5011 Class B | 2.4 and over | 4 and under | 1.35 and over |
| Slow-cooled blast furnace slag | 2.56 | 3.15 | 1.55 |
| Slag of the present invention | 2.55 | 1.42 | 1.53 |

As is clear from Table 2, the slag of the present invention sufficiently satisfies the specified physical properties of blast furnace slag coarse aggregate for concrete, Class B of JIS A 5011, and shows an absolute density and a unit weight of the same order, but a water absorption of under a half, as compared with the conventional slow-cooled blast furnace slag.

River gravel from Atsugi, Japan, and crushed stone comprising hard sandstone from Okutama, Japan, and the conventional slow-cooled blast furnace slag, prepared for comparison purpose, and the slag of the present invention were subjected to particle size adjustment for use as a coarse aggregate for concrete. Ordinary Portland cement and fine aggregate were added to each of the slag of the present invention, the river gravel, the crushed stone and the conventional slow-cooled blast furnace slag as the coarse aggregate, and concrete samples were prepared so as to give slump heights of 8 cm, 15 cm and 21 cm in the slump test. Compressive strength was measured on concrete test specimens obtained from the respective concrete samples thus prepared for ages of 7 days, 28 days and 91 days. The results are given in Table 3.

TABLE 3

| Slump height (cm) | Water/cement ratio (%) | Kind of coarse aggregate | Compressive strength (kg/cm$^3$) Age: 7 days | Age: 28 days | Age: 91 days |
|---|---|---|---|---|---|
| 8 | 45 | River gravel | 314 | 412 | 419 |
| | | Crushed stone | 351 | 446 | 473 |
| | | Slow-cooled BF slag | 348 | 432 | 463 |
| | | Slag of the present invention | 364 | 455 | 472 |
| | 55 | River gravel | 243 | 338 | 343 |
| | | Crushed stone | 276 | 357 | 387 |
| | | Slow-cooled BF slag | 227 | 296 | 332 |
| | | Slag of the present invention | 271 | 350 | 388 |
| | 65 | River gravel | 170 | 240 | 246 |
| | | Crushed stone | 204 | 280 | 287 |
| | | Slow-cooled BF slag | 174 | 242 | 262 |
| | | Slag of the present invention | 210 | 268 | 295 |
| 45 | 45 | River gravel | 308 | 402 | 432 |
| | | Crushed stone | 349 | 448 | 497 |
| | | Slow-cooled BF slag | 361 | 448 | 471 |
| | | Slag of the present invention | 363 | 443 | 512 |
| | 55 | River gravel | 235 | 326 | 327 |
| | | Crushed stone | 272 | 348 | 278 |
| | | Slow-cooled BF slag | 243 | 318 | 358 |
| | | Slag of the present invention | 276 | 335 | 370 |
| | 65 | River gravel | 183 | 262 | 265 |
| | | Crushed stone | 194 | 263 | 286 |
| | | Slow-cooled BF slag | 165 | 226 | 231 |
| | | Slag of the present invention | 182 | 256 | 292 |
| 21 | 45 | River gravel | 289 | 406 | 409 |
| | | Crushed stone | 354 | 458 | 500 |
| | | Slow-cooled BF slag | 365 | 451 | 470 |
| | | Slag of the present invention | 355 | 461 | 517 |
| | 55 | River gravel | 239 | 336 | 341 |
| | | Crushed stone | 268 | 350 | 365 |
| | | Slow-cooled BF slag | 283 | 360 | 388 |
| | | Slag of the present invention | 265 | 349 | 384 |
| | 65 | River gravel | 171 | 239 | 243 |
| | | Crushed stone | 195 | 256 | 282 |
| | | Slow-cooled BF slag | 183 | 256 | 277 |
| | | Slag of the present invention | 181 | 258 | 279 |

[Note]
BF slag means "blast furnace" slag.

The results given in Table 3 show that the concrete prepared with the slag of the present invention has a compressive strength of the same order as that of the concrete made with the crushed stone comprising hard sandstone from Okutama, which is considered the best natural coarse aggregate, and a compressive strength far higher than that of the concrete made with river gravel from Atsugi. The aforementioned concrete test specimens were compared as to the compressive strength per unit weight of cement used. The concrete made with the slag of the present invention showed a value of the same order as that of the concrete made with crushed stone from Okutama comprising hard sandstone, a value higher by about 2% than that of the concrete made with river gravel from Atsugi, and a value higher by about 6% than that of the concrete made with the slow-cooled blast furnace slag.

The crystalline blast furnace slag manufactured with the use of the apparatus for manufacturing a crystalline blast furnace slag of the present invention described above with reference to FIGS. 1 to 4 had properties equivalent to those of the crystalline blast furnace slag, adapted to serve as a road subbase course material or a coarse aggregate for concrete, manufactured by the apparatus for manufacturing a crystalline blast furnace slag of the present invention described above with reference to FIGS. 7 and 8.

According to the method and the apparatus for manufacturing a crystalline blast furnace slag of the present invention, as described above in detail, it is possible to manufacture a crystalline blast furnace slag having the following excellent properties, thus providing industrially useful effects:

(1) The very low porosity minimizes oxidation by air, which in turn minimizes production of simple-substance sulfur ($S^0$). This inhibits production of yellow leaching liquid and permits application as a road subbase course material without providing an ageing period;

(2) Also because of the very low porosity, when using as the coarse aggregate for concrete, it is possible to obtain a concrete with a high workability requiring only a small consumption of water and cement; and, (3) Uniform cooling ensures uniform quality.

What is claimed is:

1. A method for manufacturing a crystalline blast furnace slag, characterized by comprising the steps of:

endlessly connecting at prescribed intervals a plurality of rectangular metal cooling bodies, each having a sharp top edge and a hollow for cooling water, to form a plurality of cooling grooves, each cooling groove having top end width of from 40 to 80 mm corresponding to said prescribed intervals and a depth of from 100 to 300 mm and becoming narrower toward the depth thereof, each cooling groove being between two adjacent ones of said cooling bodies;

continuously moving said plurality of cooling bodies endlessly connected in circulation in the connecting direction thereof;

continuously pouring a molten blast furnace slag sequentially into said plurality of cooling grooves extending transversely to the moving direction of said plurality of cooling bodies, in an atmosphere of at least one of an inert gas and a reducing gas, while continuing to move in circulation said plurality of cooling bodies; and, circulating a cooling water through said plurality of hollows for cooling water of said plurality of cooling bodies during pouring of the molten blast furnace slag into said plurality of cooling grooves, to cool said plurality of cooling bodies, thereby cooling and solidifying the molten blast furnace slag poured into said plurality of cooling grooves by the contact with mutually facing outer surfaces of two adjacent ones of said cooling bodies thus cooled, to manufacture a crystalline blast furnace slag.

2. An apparatus for manufacturing a crystalline blast furnace slag, characterized by comprising:

a rotary drum having a substantially circular barrel, formed by endlessly connecting at prescribed intervals a plurality of rectangular metal cooling bodies, each having a sharp top edge and a hollow for cooling water, the barrel of said rotary drum having on the outer circumference thereof a plurality of cooling grooves formed by the mutually facing outer surfaces of two adjacent ones of said cooling bodies at intervals corresponding to said prescribed intervals, each of said plurality of cooling grooves extending substantially transversely to the rotating direction of said rotary drum and becoming narrower toward the depth thereof, each of said plurality of cooling grooves comprising an inlet section outwardly flaring for introducing a molten blast furnace slag, and a cooling section following said inlet section, becoming narrower toward the depth thereof for cooling and solidifying the molten blast furnace slag poured therein into a crystalline blast furnace slag, the top end width of said cooling section being within the range of from 40 to 80 mm;

a plurality of pushing boards for forming the respective bottom surfaces of said plurality of cooling grooves and for pushing out the crystalline blast furnace slag solidified in said plurality of cooling grooves, each of said plurality of pushing boards comprising a rectangular plate having a length substantially equal to the length of said cooling groove and a stopper, fixed to an end of said plate, having a length greater than the length of said plate, the ends of said stopper projecting from both sides of said rotary drum, each of said plurality of pushing boards being fitted to the bottom of each of said plurality of cooling grooves in such a manner that the other end of said plate is inserted into the lower part of said cooling groove and the end of said plate fixed with said stopper projects from the inner surface of the barrel of said rotary drum, and that said pushing board is slidable along the depth direction of said cooling groove, whereby the tip of said other end of said plate inserted into said cooling groove forms the bottom surface of said cooling groove, and said cooling section of said cooling groove has a depth within the range of from 100 to 300 mm, when said pushing board is at the lowest position thereof;

a driving means connected to the center axle of said rotary drum, for rotating said rotary drum;

a molten slag container arranged above said rotary drum, said molten slag container being adapted to receive a molten blast furnace slag discharged from a blast furnace, and to continuously pour the molten blast furnace slag thus received, in an appropriate amount, sequentially into said cooling grooves reaching near the highest position of the barrel of said rotary drum, along with the rotation of said drum;

a gas supply means including a hood fitted to the lower part of said molten slag container above said rotary drum, said gas supply means being adapted to fill said hood with a shielding gas comprising at least one of an inert gas and a reducing gas, and to prevent a molten blast furnace slag from contacting with air by said shielding gas during pouring of the molten blast furnace slag from said molten slag container into said cooling grooves;

a cooling mechanism for cooling said plurality of cooling bodies heated by a molten blast furnace slag at a high temperature poured into said plurality of cooling grooves, said cooling mechanism comprising an annular pipe for supplying cooling water fixed to the outside of a side of said rotary drum along the circumference thereof, an external cooling water supply pipe for water-tightly communicating said annular pipe for supplying cooling water to a cooling water source, an annular pipe for discharging cooling water fixed to the outside of the other side of said rotary drum along the circumference thereof, and an external cooling water discharge pipe for water-tightly communicating said annular pipe for discharging cooling water to the cooling water source, a longitudinal end of each of said plurality of hollows for cooling water of said plurality of cooling bodies water-tightly communicating, through a short supply pipe, with said annular pipe for supplying cooling water, said annular pipe for supplying cooling water water-tightly communicating, through a connecting pipe and a hollow portion provided at an end of the center axle of said rotary drum, with said external cooling water supply pipe, on the other hand, the other longitudinal end of each of said plurality of hollows for cooling water of said plurality of cooling bodies water-tightly communicating, through a short discharge pipe, with said annular pipe for discharging cooling water, said annular pipe for discharging cooling water water-tightly communicating, through another connecting pipe and another hollow portion provided at the other end of the center axle of said rotary drum, with said external cooling water discharge pipe, thus, cooling water from the cooling water source being supplied into each of said plurality of hollows for cooling water of said plurality of cooling bodies, through said external cooling water supply pipe, the hollow portion of the first end of said center axle, said connecting pipe, said annular pipe for supplying cooling water and said short supply pipes, and being discharged to outside from each of said plurality of hollows for cooling water of said plurality of cooling bodies, through said short discharge pipes, said annular pipe for discharging cooling water, said other connecting pipe, said other hollow portion of the other end of said center axle and said external cooling water discharge pipe, thereby cooling said plurality of cooling bodies; and, a pair of strippers for discharging by pushing to the outside a crystalline blast furnace slag solidified in said plurality of cooling grooves, said pair of strippers being stationarily arranged, outside the lower portions of the both sides of said rotary drum, one at each of positions where said pair of strippers are in contact with the lower surfaces of the both ends of said stopper of said pushing board, projecting from the both sides of said rotary drum, and, said pair of strippers being adapted to discharge by pushing to the outside the crystalline blast furnace slag solidified in said cooling grooves by sequentially pushing said pushing boards into said cooling grooves.

3. The apparatus as claimed in claim 2, wherein:

a pair of restorers are provided downstream of said pair of strippers relative to the rotating direction of said rotary drum, said pair of restorers are stationarily arranged, outside the both sides of said rotary drum, one at each of positions where said pair of restorers are adjacent the lower surfaces of the both ends of said stopper of said pushing board, projecting from the both sides of said rotary drum, and, said pair of restorers are adapted to sequentially withdraw said pushing boards pushed into said cooling grooves to the lowermost positions thereof.

4. An apparatus for manufacturing a crystalline blast furnace slag, characterized by comprising:

an endless conveyor belt including a pair of pulleys, formed by endlessly connecting a plurality of rectangular cooling metal members, each of said plurality of cooling metal members being formed by connecting at prescribed intervals a plurality of rectangular metal cooling bodies, each having a sharp top edge and a hollow for cooling water, each of said plurality of cooling metal members having on the outer surface thereof a plurality of cooling grooves formed by the mutually facing outer surfaces of two adjacent ones of said cooling bodies at intervals corresponding to said prescribed intervals, each of said plurality of cooling grooves extending substantially transversely to the travelling direction of said endless conveyor belt and becoming narrower toward the depth thereof, each of said plurality of cooling grooves comprising an inlet section outwardly flaring for introducing a molten blast furnace slag, and a cooling section following said inlet section, becoming narrower toward the depth thereof for cooling and solidifying the molten blast furnace slag poured therein into a crystalline blast furnace slag, the top end width of said cooling section being within the range of from 40 to 80 mm;

a plurality of pushing boards for forming the respective bottom surfaces of said plurality of cooling grooves and for pushing out the crystalline blast furnace slag solidified in said plurality of cooling grooves, each of said plurality of pushing boards comprising a rectangular plate having a length substantially equal to the length of said cooling groove and a stopper fixed to an end of said plate, each of said plurality of pushing boards being fitted to the bottom of each of said plurality of cooling grooves in such a manner that the other end of said plate is inserted into the lower part of said cooling groove and the end of said plate fixed with said stopper projects from the back surface of said cooling metal member, and that said pushing board is slidable along the depth direction of said cooling groove, whereby the tip of said other end of said plate inserted into said cooling groove forms the bottom surface of said cooling groove, and said cooling section of said cooling groove has a depth within the range of from 100 to 300 mm, when said pushing board is at the lowest position thereof;

a driving means connected to at least one of said pair of pulleys, for travelling said endless conveyor belt;

a molten slag container arranged above the upstream end of the upper forward position of said endless conveyor belt, said molten slag container being adapted to receive a molten blast furnace slag discharged from a blast furnace, and to continuously pour the molten blast furnace slag thus received, in an appropriate amount, sequentially into said cooling grooves of said cooling metal member reaching the upstream of the upper forward position of said endless conveyor belt, along with the travel of said endless conveyor belt;

a gas supply means including a hood fitted to the lower part of said molten slag container above said endless conveyor belt, said gas supply means being adapted to fill said hood with a shielding gas comprising at least one of an inert gas and a reducing gas, and to prevent a molten blast furnace slag from contacting with air by said shielding gas during pouring of the molten blast furnace slag from said molten slag container into said cooling grooves;

a cooling mechanism for cooling said plurality of cooling bodies heated by a molten blast furnace slag at a high temperature poured into said plurality of cooling grooves, said cooling mechanism comprising an external cooling water supply pipe and an external cooling water discharge pipe rotatably fitted to a particular one of said plurality of cooling metal members, a plurality of connecting pipes for serially and water-tightly communicating said plurality of hollows for cooling water of said plurality of cooling bodies of each of said plurality of cooling metal members, and, a plurality of liaison pipes for water-tightly communicating the hollow for cooling water of the last cooling body of any cooling metal member to the hollow for cooling water of the first cooling body of the next cooling metal member, said external cooling water supply pipe water-tightly communicating with the hollow for cooling water of a cooling body of said particular cooling metal member, and, said external cooling water discharge pipe water-tightly communicating with the hollow for cooling water of the cooling body immediately following the cooling body communicated to said external cooling water supply pipe, thus cooling water from a cooling water source being introduced through said external cooling water supply pipe into the hollow for cooling water of a cooling body of said particular cooling metal member, then, passing sequentially through the hollows for cooling water of the cooling bodies of said particular cooling metal member via said connecting pipes, then, being introduced, through said liaison pipes, into the hollow for cooling water of the first cooling body of the next cooling metal member, then, passing sequentially through the hollows for cooling water of all the cooling bodies of said next cooling metal member, and, after passing through the hollows for cooling water of all the cooling bodies of said plurality of cooling metal members in this manner, being discharged, through said external cooling water discharge pipe, to the outside from the hollow for cooling water of the last cooling body, thereby cooling said plurality of cooling bodies of said plurality of cooling metal members; and, a stripper for discharging by pushing to outside a crystalline blast furnace slag solidified in said plurality of cooling grooves, said stripper being stationarily arranged, upstream of the lower returning position of said endless conveyor belt, at a position where said stripper is in contact with the lower surface of said stopper of said pushing board, and, said stripper being adapted to discharge by pushing to the outside the crystalline blast furnace slag solidified in said cooling grooves by sequentially pushing said pushing boards into said cooling grooves.

5. The apparatus as claimed in claim 4, wherein:

a restorer is provided downstream of said stripper relative to the travelling direction of said endless conveyor belt, said restorer is stationarily arranged in the upper forward position of said endless conveyor belt, at a position where said restorer is adjacent the lower surface of said stopper of said pushing board, and, said restorer is adapted to sequentially withdraw said pushing boards pushed into said cooling grooves to the lowermost positions thereof.

* * * * *